US005690187A

United States Patent [19]

Wang et al.

[11] Patent Number: 5,690,187

[45] Date of Patent: Nov. 25, 1997

[54] LIFE-SAVING TRAVEL BAG

[76] Inventors: Wen-Chung Wang, 2F., No. 36, Lane 13, Chi-Hsiang St., Hsintien City, Taipei County, Taiwan; Min-Long Chuang, 4/F., No. 120, Kuang-Ming Rd., Sanchung City, Taipei County, Taiwan

[21] Appl. No.: 695,431

[22] Filed: Aug. 12, 1996

[51] Int. Cl.[6] ..... A62B 1/06

[52] U.S. Cl. ..... 182/70; 182/5; 182/72; 182/193

[58] Field of Search ..... 182/5, 70, 71, 182/72, 191, 193, 241

[56] References Cited

U.S. PATENT DOCUMENTS

| | | | |
|---|---|---|---|
| 267,399 | 11/1882 | Borgfeldt | 182/70 |
| 632,226 | 8/1899 | Menges | 182/70 |
| 722,110 | 3/1903 | Johnston | 182/241 X |
| 4,583,616 | 4/1986 | Baker | 182/70 X |
| 4,730,696 | 3/1988 | Johnson | 182/70 X |
| 4,788,926 | 12/1988 | Ullman et al. | 182/70 X |
| 4,989,691 | 2/1991 | Wilkerson et al. | 182/70 |
| 5,074,236 | 12/1991 | Robertson | 182/70 X |
| 5,076,394 | 12/1991 | Sheu | 182/70 |

*Primary Examiner*—Alvin C. Chin-Shue
*Assistant Examiner*—Richard M. Smith
*Attorney, Agent, or Firm*—Morton J. Rosenberg; David I. Klein

[57] ABSTRACT

A life-saying travel bag includes a suitably long, wide and durable rope sewn with a zipper on each side such that the rope forms a substantially cylindrical bag when the side zippers are closed. A fastening mechanism is disposed near either end on the inside of the bag, and a fastening strap is arranged at either end of the bag for connecting to a shoulder strap for carrying. An upper cover and a lower cover are respectively connected to the ends of the bag by zippers. The upper cover accommodates a speed control means which has a narrow recess at its center for containing an adjusting rod with an eccentric shaft. The ends of the shaft are connected to a control lever which may bring the adjusting rod to rotate towards or away from the opening of the recess so that the rod may be retained at or disengage from the opening to achieve the object of control. The zippers may be opened so that the rope is extended to its full length. One end of the rope may be tied to a secure structure of the building while the user is firmly suspended on the rope by means of the shoulder strap and fastening mechanism. The user may manipulate the control lever to drop at a safe speed to the ground.

3 Claims, 5 Drawing Sheets

LIFE-SAVING TRAVEL BAG

BACKGROUND OF THE INVENTION (a) Field of the Invention

The present invention relates to a life-saying travel bag, and more particularly to a travel bag which may be used as a life-saying device to help the user to escape from a tall building during fire accidents.

(b) Description of the Prior Art

Fire accidents in tall buildings are very frequent today, and death tolls are relatively heavy at higher floors. People trapped inside a tall building are either suffocated to death by the smoke or forced to risk jumping off the building. It is therefore imperative that a simple and portable life-saying device is provided to help people unfortunately trapped in a tall building during fire accidents to escape to safe ground.

SUMMARY OF THE INVENTION

Accordingly, a primary object of the present invention is to provide a life-saying travel bag which not only has the functions of an ordinary travel bag but may also be used a life-saying device to help the user to jump off a tall building during emergency.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
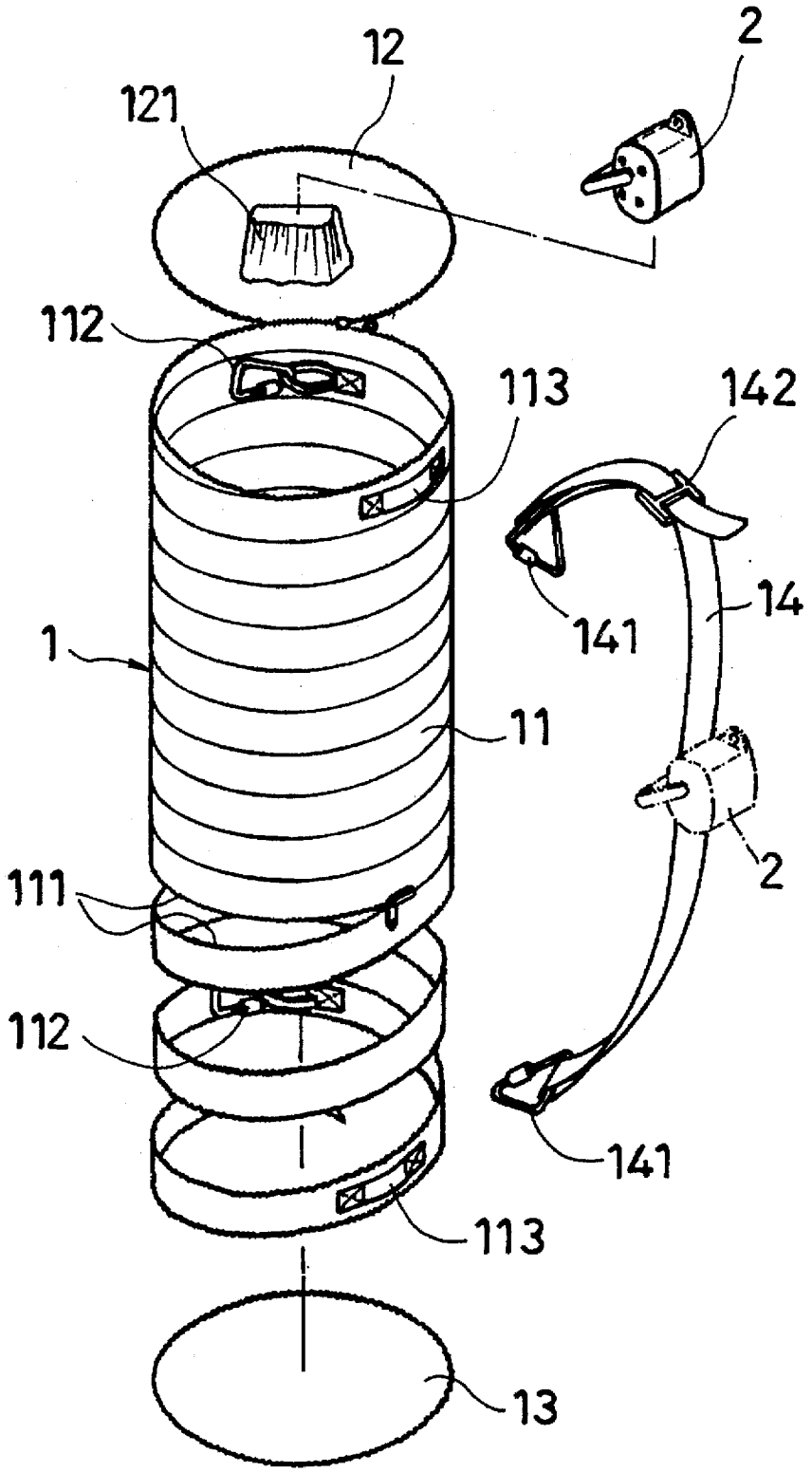
FIG. 1 is an elevational exploded view of the present invention.

With reference to FIG. 1, the life-saying travel bag according to the present invention essentially comprises a travel bag 1 including a rope body 11 of a suitable length and width and sewn with a zipper 111 at both sides thereof. The zippers 111 at both sides may be closed to fix the rope body 11 into a cylindrical bag shape. A fastening means 112 is disposed at a suitable position on the inner side of the rope body 11 near either end thereof. A fastening strap 113 is further provided on the outside of the rope body 11 near its ends. The two fastening straps 113 may be fastened onto two fastening rings 141 at the respective ends of a shoulder strap 14 that is fastened to the travel bag 1. An adjusting element 142 is provided on the shoulder strap 14 at a suitable position for adjusting the length of the shoulder strap 14. An upper cover 12 and a lower cover 13 are respectively connected to the cylindrical travel bag 1 by means of zippers to serve as openings. An inner pocket 121 is provided at the inner side of the upper cover 12 for accommodating a speed control means 2.

Figure 2A:
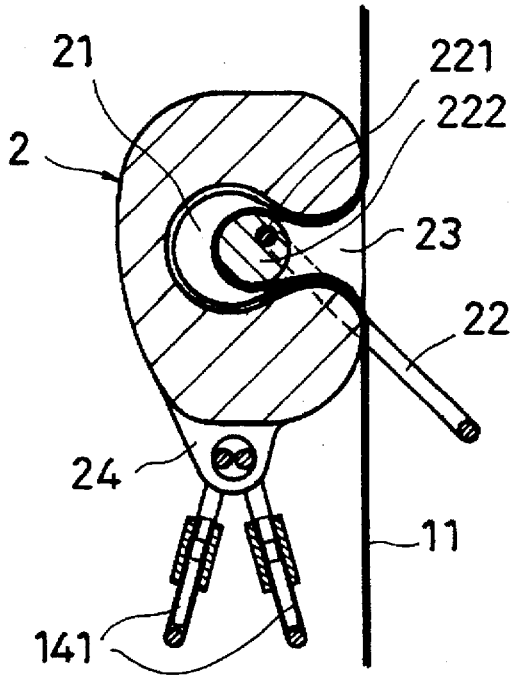
FIG. 2A is a sectional view of the speed control means in which a control lever is pulled downwardly.
Figure 2:
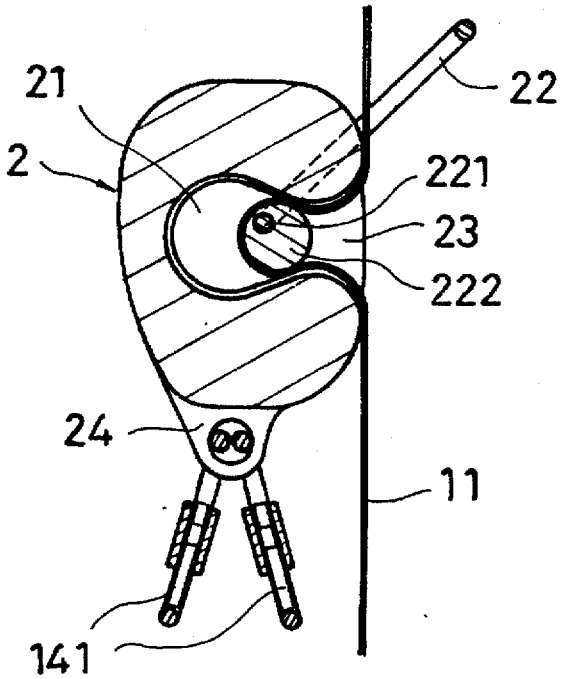
FIG. 2 is a sectional view of a speed control means accorded to the present invention.
Figure 3:
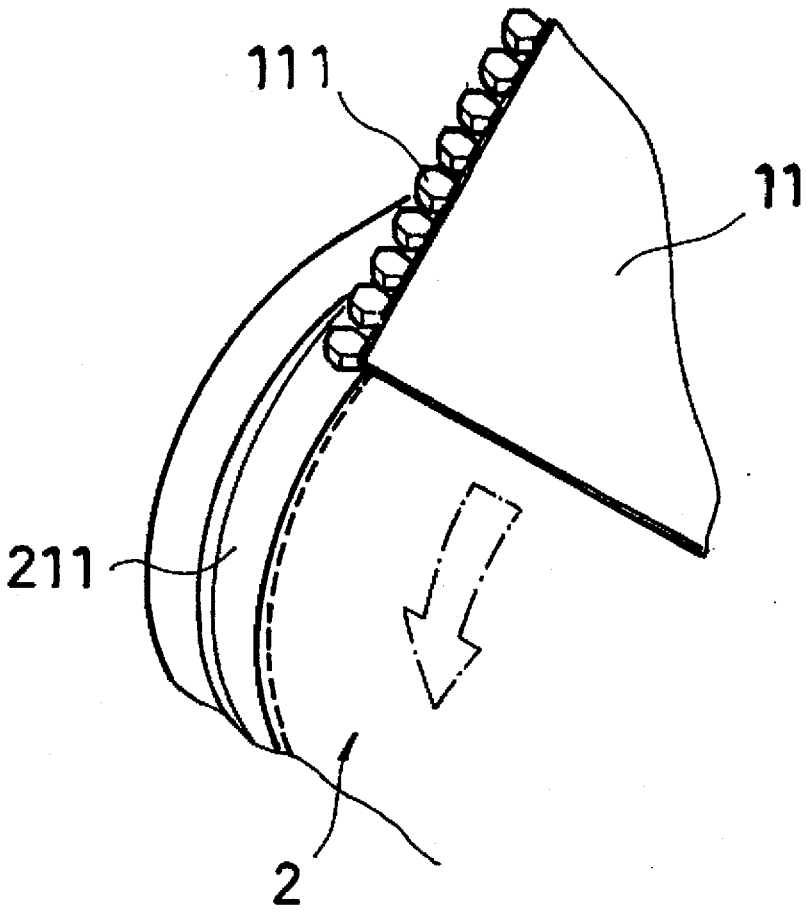
FIG. 3 is a sectional view showing a zipper of a rope body displace along a slide groove of a speed control means when the rope body is fitted into the speed control means.
Figure 4:
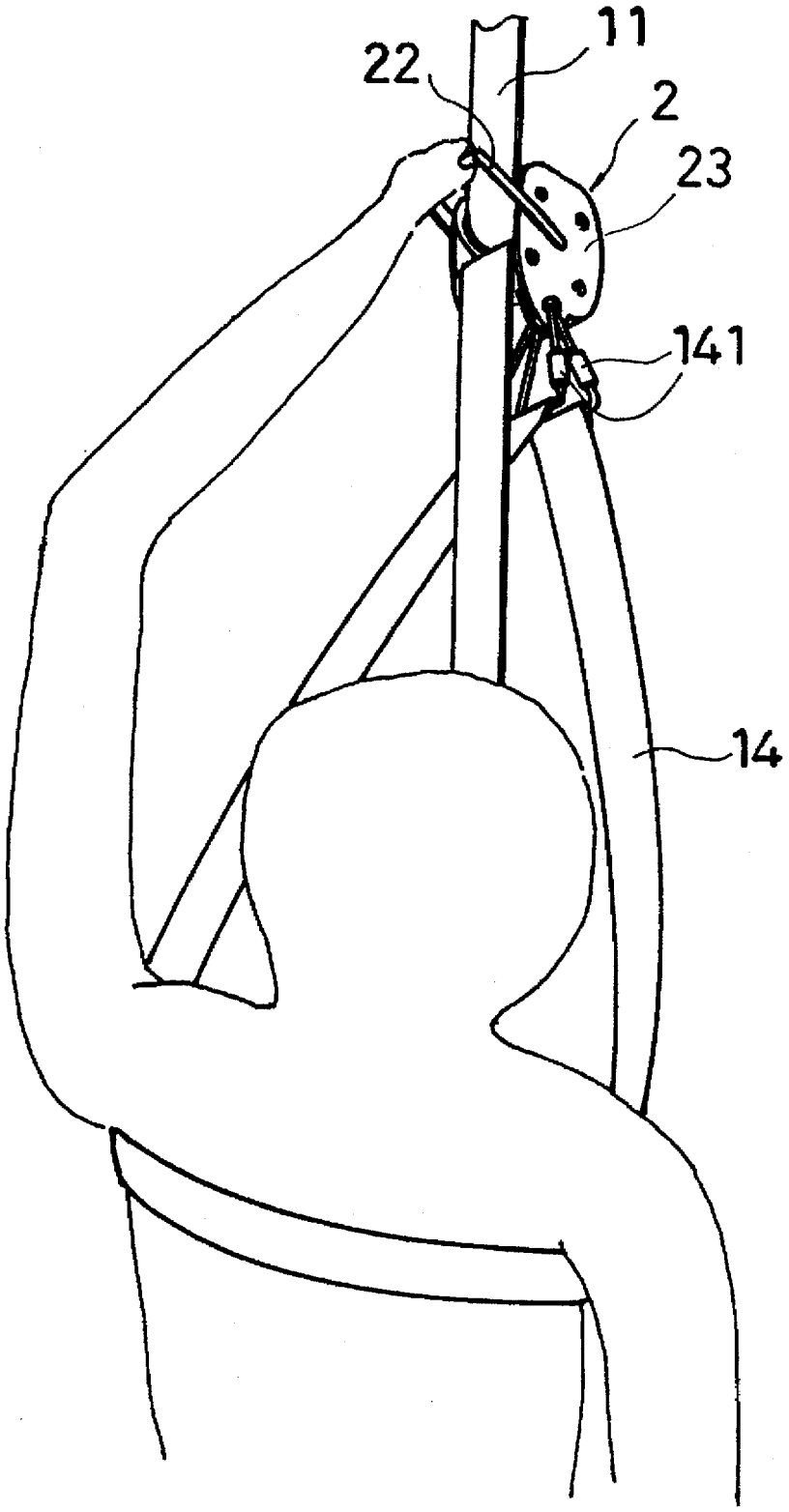
FIG. 4 is an elevational view illustrating use of the life-saving travel bag of the present invention.

With reference to FIG. 2, the speed control means 2 is a substantially U-shaped cylindrical body with a housing 23 locked to each end. A narrow recess 21 having a narrow opening is disposed at the center of the speed control means 2 to form a slide surface for the rope body 11. Each side of the slide surface is provided with a zipper groove 211 of a greater depth for smooth passage of the relatively thicker zippers 111 of the rope body 11 so as not to obstruct the movement of the rope body 11. The recess 21 contains an adjusting rod 222 having an eccentric shaft 221 that is fastened to the two housings 23 of the speed control means 2 for enabling the adjusting rod 222 to eccentrically rotate about the eccentric shaft 221 at different radii. In addition, the diameter of the adjusting rod 222 is greater than that of the recess 21 so that the former will not slip out of the recess 21. The surface of the adjusting rod 222 is also provided with slide grooves for smooth passage of the zippers 111 of the rope body 11. Those parts of the ends of the eccentric shaft 221 that project from the housings 23 are commonly connected to a control lever 22 which, when pulled, may bring the adjusting rod 222 to rotate towards or away from the opening of the recess 21, achieving the object of control. A fastening ring portion 23 is integrally provided at the bottom of the speed control means 2 for connecting to the fastening rings 141 of the shoulder strap 14.

Use of the life-saving travel bag according to the present invention will be illustrated with reference to FIGS. 1, 2A, 3 and 4. First of all, the shoulder strap 14 as well as the upper and lower covers 12, 13 are removed. The zippers 111 are then opened so that rope body 11 forming the travel bag 1 is extended to its full length. The fastening means 112 at one end of the rope body 11 is then secured to any suitable fixed object or structure of the building so that the rope body 11 stretches downwardly to the ground surface. The speed control means 2 is next removed from the inner pocket 121 of the upper cover 12 and fastened firmly to the rope body 11. On the other hand, the shoulder strap 14 is passed under the armpits of the user and the fastening rings 141 at the ends of the shoulder strap 14 are fastened to the fastening ring portion 24 at the bottom of the speed control means 2 so that the user may be securely suspended on the rope body 11 and the speed adjusting means 2. By holding the control lever 22 of the speed control means 2, the user may freely control the dropping speed so that he/she may land safely. If circumstances permit, the user may then retrieve the rope body 11 and the speed control means 2. The same rope body 11 may be used to save people individually equipped with the speed control means 2.

To fasten the speed control means 2 to the rope body 11, the rope body 11 is passed into the recess 21 of the speed control means 2 round the adjusting rod 222 and out through the recess 21 again. When in use, the user's weight is imposed on the speed control means 2, creating a downward force, so that the rope body 11 may pull the adjusting rod 222 to rotate towards the opening of the recess 21 and be checked at the opening of the recess 21. As the rope body 11 may be firmly gripped between the speed control means 2 and the adjusting rod 222, the adjusting rod 222 and the user may be effectively suspended at any part of the rope body 11 and remain stationary. If the control lever 22 is pulled downwardly at this point, the adjusting rod 222 will be brought to rotate inwardly. Since this is an eccentric rotation at irregular radii, a sufficiently large clearance will be formed between the surface of the recess 21 and the surface of the adjusting rod 222 to permit movement of the rope body 11. Added with the weight of the user, the rope body 11 carrying the user may slide downwardly in a speedy manner. But since sufficient friction will be generated when the rope body slide past the speed control means 2, the speed of the rope 11 will not be so fast as to endanger the life of the user. If the falling speed is too fast, the user may pull the control lever upwardly so that the adjusting rod 222 may be retained at its original position and the fall is stopped.

Figure 5:
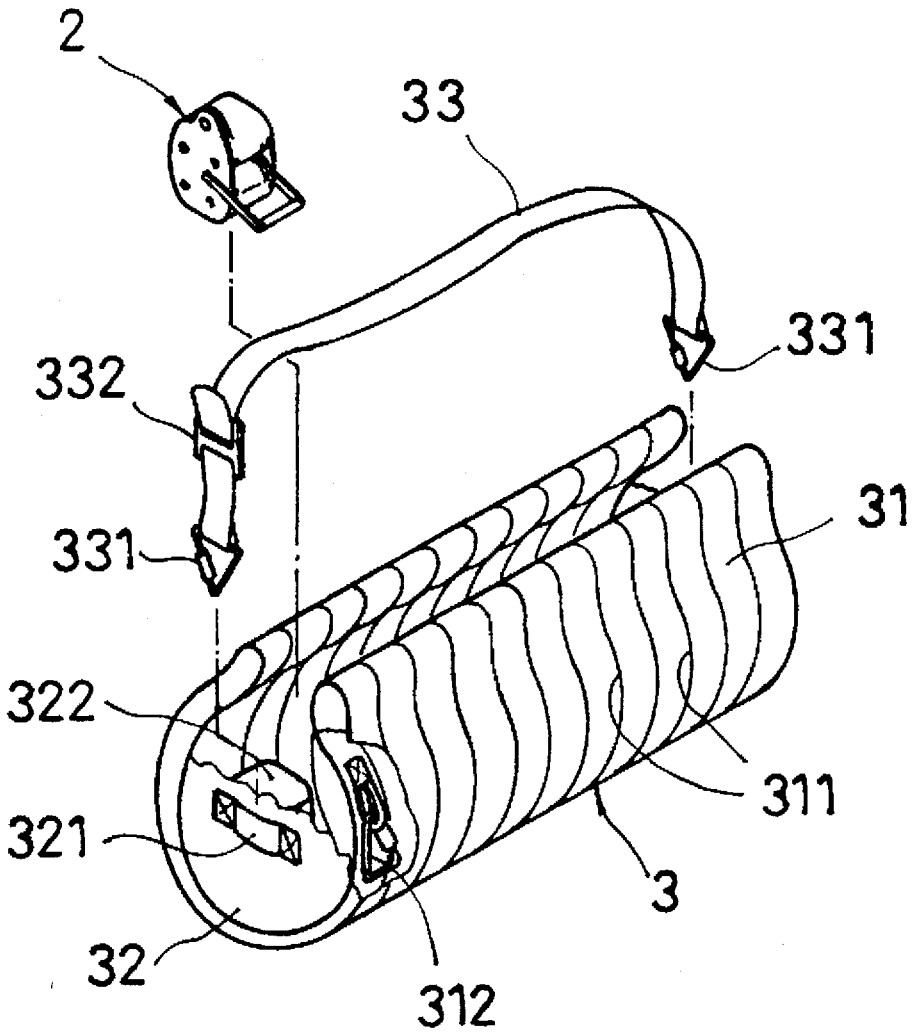
FIG. 5 is an elevational view of another preferred embodiment of the present invention.

Reference is now made to FIG. 5, showing a second preferred embodiment of the present invention. A travel bag 3 includes a rope body 31 provided with zippers 311, the rope body 31 being configured to fold twice to form a substantially cylindrical bag with a substantially triangular top portion. The travel bag 3 is provided with a zipper 311 at each end to connect to a side cover 32. A fastening ring 312 is sandwiched between the two layers of rope body 11. A fastening strap 321 is disposed at the outer side of the side cover 32 for connection with a fastening ring 331 of a shoulder strap 33. An adjusting element 332 is provided on the shoulder strap 33 at a suitable position for adjusting the length of the shoulder strap 33. On the inner side of the same side cover 32, an inner pocket 322 is provided to accommodate the speed control means 2.

Although the present invention has been illustrated and described with reference to the preferred embodiment thereof, it should be understood that it is in no way limited to the details of such embodiment but is capable of numerous modifications within the scope of the appended claims.

What is claimed is:

1. A life-saving travel bag, comprising a rope body of a suitable length and width and sewn with two zippers each at one side thereof, said rope body forming a substantially cylindrical bag in an upright position when said two zippers are closed, said rope body having a fastening means at an inner side thereof at a suitable position near each end thereof, two fastening straps being respectively disposed at one side of the cylindrical bag at an upper end and a lower end, said fastening straps being respectively connected to two fastening rings at two ends of a shoulder strap so that said shoulder strap may be connected to the cylindrical bag for carrying purposes, an adjusting element being provided at said shoulder strap for adjusting the length thereof, an upper cover and a lower cover being respectively connected to the upper end and lower end of the cylindrical bag by means of zippers to serve as openings of the bag, an inner pocket being provided at an inner side of said upper cover for accommodating a speed control means, said rope body being extended to its full length by opening said zippers when in use, said fastening means at one end of said rope body being adapted to be fastened to any fixed structure of a building so that said rope body may drop to a ground surface, a speed control means being adapted to be fastened to said rope body and said shoulder strap being adapted to be passed under the armpits of a user, said fastening rings of said shoulder strap being adapted to be fastened to a fastening ring portion at a bottom side of said speed control means so that the user may be suspended on said speed control means and said rope body and may drop safely downwardly to the ground surface by controlling a control lever of said speed control means.

2. The life-saying travel bag as claimed in claim 1, wherein said speed control means is a substantially U-shaped cylindrical structure having a housing locked to each end, said speed control means being provided with a narrow recess having a narrow opening at a center thereof, said recess forming a slide surface for said rope body and being provided with a slide groove of a greater depth at each side for passage of said zipper at either side of said rope body, said recess accommodating an adjusting rod having an eccentric shaft that is fastened to said housings of said speed control means so that said adjusting rod may rotate eccentrically about said eccentric shaft at different radii, said adjusting rod having a diameter greater than that of said recess so that it may not slip out of said recess, said adjusting rod further having a slide groove at each rod side for passage of said zipper at either side of said rope body, said eccentric shaft having ends projecting from said recess and being commonly connected to said control lever which may be pulled to bring said adjusting rod to rotate towards or away from the opening of said recess so that said adjusting rod may be retained at or disengage from the opening of said recess to achieve the object of controlling the falling speed.

3. A life-saving travel bag comprising a rope body of a suitable length and width and sewn with two zippers each at one side thereof, wherein said rope body may be configured to fold twice to form a substantially cylindrical bag with a substantially triangular top portion in a horizontal position when said zippers at the sides are closed, said rope body having a fastening means at an inner side thereof at a suitable position near each end of said rope body, said bag having two lateral sides, each lateral side being connected to a side cover by a zipper, each said side cover zipper being sandwiched between two layers of the rope body near each lateral side, a fastening strap disposed at an outer side of each side cover, a shoulder strap for carrying purposes, an adjusting element being provided at said shoulder strap for adjusting the length thereof, said strap including a fastening ring at both strap ends for connecting to said side covers, said rope body being extended to its full length by opening said zippers when in use, said fastening means at one end of said rope body being adapted to be fastened to any fixed structure of a building so that said rope body may drop to a ground surface, a speed control means being adapted to be fastened to said rope body and said shoulder strap being adapted to be passed under the armpits of a user, said fastening rings of said shoulder strap being adapted to be fastened to a fastening ring portion at a bottom side of said speed control means so that the user may be suspended on said speed control means and said rope body and may drop safely downwardly to the ground surface by controlling a control lever of said speed control means.

* * * * *